US012232521B2

(12) United States Patent
Khachatryan et al.

(10) Patent No.: US 12,232,521 B2
(45) Date of Patent: Feb. 25, 2025

(54) HOOKAH DEVICE

(71) Applicant: ADALSIA LIMITED, Limassol (CY)

(72) Inventors: Artyom Khachatryan, Yerevan (AM); Mikhail Broyan, Yerevan (AM); John Michael Elam, Woodland Hills, CA (US); Alexander Gilbert, McLean, VA (US); Jackson Hedden, Santa Monica, CA (US); Frank Tyneski, Thousand Oaks, CA (US)

(73) Assignee: ADALSIA LIMITED, Limassol (CY)

( * ) Notice: Subject to any disclaimer, the term of this patent is extended or adjusted under 35 U.S.C. 154(b) by 0 days.

(21) Appl. No.: 18/203,879

(22) Filed: May 31, 2023

(65) Prior Publication Data

US 2023/0380484 A1 Nov. 30, 2023

Related U.S. Application Data

(62) Division of application No. 17/435,141, filed as application No. PCT/IB2020/000117 on Mar. 6, 2020.
(Continued)

(51) Int. Cl.
*A24F 1/30* (2006.01)
*A24D 1/14* (2006.01)
(Continued)

(52) U.S. Cl.
CPC ..... *A24F 1/30* (2013.01); *A24D 1/14* (2013.01); *A24F 5/00* (2013.01); *A24F 40/20* (2020.01); *A24F 40/42* (2020.01); *A24F 40/46* (2020.01)

(58) Field of Classification Search
CPC ..... A24D 1/14; A24F 40/42
See application file for complete search history.

(56) References Cited

U.S. PATENT DOCUMENTS 8,983,282 B2 3/2015 Bishara
9,877,517 B2 1/2018 Liu
(Continued)

FOREIGN PATENT DOCUMENTS

EP 2292108 9/2011
IN 2009DE01413 7/2009
(Continued)

OTHER PUBLICATIONS

Anders K. Nelson, Lightning Hookah, found at https://www.andersknelson.com/blog/?p=354, published Nov. 21, 2017.
(Continued)

*Primary Examiner* — Christopher M Rodd
*Assistant Examiner* — Jennifer A Kessie
(74) *Attorney, Agent, or Firm* — RISSO I.P.

(57) ABSTRACT

Described is a hookah device. The hookah device includes a unique hookah head and consumable pod. The hookah head includes a bowl portion with a pod recess formed therein to receive a consumable pod. An electronic heating mechanism is positioned within the hookah head for heating the consumable pod. An air pathway is formed through the hookah head to introduce air into the consumable pod and direct smoke from the consumable pod into a hookah body. The consumable pod is similarly formed to fit within the hookah head. Further, the consumable pod includes a pod inlet and pod outlet for directing air through the pod and through the hookah device for inhalation.

3 Claims, 11 Drawing Sheets

Related U.S. Application Data

(60) Provisional application No. 62/929,273, filed on Nov. 1, 2019, provisional application No. 62/815,167, filed on Mar. 7, 2019.

(51) Int. Cl.

| | |
|---|---|
| ***A24F 5/00*** | (2006.01) |
| ***A24F 40/20*** | (2020.01) |
| ***A24F 40/42*** | (2020.01) |
| ***A24F 40/46*** | (2020.01) |

(56) References Cited

U.S. PATENT DOCUMENTS

| | | | | |
|---|---|---|---|---|
| 10,206,424 | B1 | 2/2019 | Gammerler | |
| 2014/0256014 | A1 | 9/2014 | Bishara | |
| 2016/0029696 | A1 | 2/2016 | Obeidallah | |
| 2017/0099873 | A1* | 4/2017 | Benjamignan ..... | H05B 1/0244 |
| 2017/0251718 | A1 | 9/2017 | Armoush et al. | |
| 2020/0113235 | A1* | 4/2020 | Fernando ..... | A24F 40/465 |

FOREIGN PATENT DOCUMENTS

| | | |
|---|---|---|
| WO | WO 2010098782 | 9/2010 |
| WO | WO 2014012216 | 1/2014 |
| WO | WO 2014118787 | 8/2014 |
| WO | WO 2015143637 | 10/2015 |
| WO | WO 2017178932 | 10/2017 |
| WO | WO 2019003116 | 1/2019 |
| WO | WO 2019003117 | 1/2019 |
| WO | WO 2019016737 | 1/2019 |

OTHER PUBLICATIONS

Power Hookah, by Power Hookah, found at https://www.powerhookah.com/, published Mar. 23, 2018.

International Search Report, PCT/IB2020/000117, dated May 15, 2020.

Written Opinion of the International Searchign Authority, PCT/IB2020/00017, dated May 15, 2020.

International Preliminary Report on Patentability, PCT/IB2020/000117, dated Feb. 24, 2021.

* cited by examiner

100

HOOKAH DEVICE

CROSS-REFERENCE TO RELATED APPLICATIONS

This is a Divisional application of U.S. Nonprovisional application Ser. No. 17/435,141, filed on Aug. 31, 2021, which is a U.S. national stage filing of PCT/IB2020/000117, filed on Mar. 6, 2020, which is an international PCT application of U.S. Provisional Application No. 62/815,167, filed on Mar. 7, 2019 and U.S. Provisional Application No. 62/929,273, filed on Nov. 1, 2019, the entirety of which are incorporated herein by reference.

BACKGROUND OF THE INVENTION

(1) Field of Invention

The present invention relates to a hookah device and, more particularly, to various hookah components individually and, collectively, as forming a complete hookah device designed to smoke combustible items.

(2) Description of Related Art

Hookah devices have long been known in the art and are generally operable to burn and smoke shisha and other combustibles. However, while various designs of a hookah have been conceived, each design has its shortcomings. By way of example, a traditional hookah has a clay or ceramic head that is used to contain the combustible product (e.g., shisha). In operation, a user places the shisha within the head and then uses a flame (via a lighter or other ignition device) to ignite and burn the shisha. Such a process requires a skilled hookah user to properly pack the shisha. Further, due to the ignition process, the hookah takes too long to prepare and heat and, importantly, does not burn evenly. Finally, as the shisha is burned, ash or other residue remains within the head which requires cleaning, a time-consuming process.

In an attempt to address some of the issues with traditional hookahs, electronic hookahs have been developed. The modern electronic hookahs use an electronically powered heater to heat and/or burn the shisha. A problem with such existing systems is that the heat is not distributed evenly and there is leakage in the air flow.

Thus, a continuing need exists for a smart hookah with components that are designed to improve upon the various aspects and functions of existing hookah devices.

SUMMARY OF THE INVENTION

The present disclosure is directed to a hookah device. The hookah device includes a hookah head. In various aspects, the hookah head includes a bowl portion with a pod recess formed therein to receive a consumable pod. An electronic heating mechanism is positioned proximate the pod recess for heating a consumable pod. Further, an air pathway is formed through the hookah head. The air pathway is formed to introduce air into a consumable pod and direct smoke from the consumable pod into a hookah body.

In another aspect, a hookah body is connected to the hookah head. The hookah body comprises a vase with a down stem projecting into the vase. A hose port is in fluid communication with the vase for receiving smoke from the hookah head, through the down stem, and out of the hose port for inhalation by a user.

In yet another aspect, the electronic heating mechanism is positioned above the pod recess such that any consumable pod positioned within the pod recess is heated from above the pod recess.

In yet another aspect, the electronic heating mechanism includes an electric heater and a heating plate.

In another aspect, the hookah head includes a bowl top having the electric heater affixed therein such that the heating plate is positioned below the electric heater, wherein when a consumable pod is placed within the pod recess, the heating plate is affixed between the electric heater and the consumable pod.

In yet another aspect, an air pathway is formed through both the bowl top and bowl portion such that when a consumable pod is positioned within the bowl portion, the air pathway aligns with openings within the consumable pod.

Further, the air pathway in the bowl top includes both a top inlet and a top outlet. The top inlet is formed to align with a pod inlet and the top outlet formed to align with a pod outlet, such that the top inlet directs ambient air into a consumable pod while the top outlet directs smoke from a consumable pod to a smoke passageway formed through the bowl portion.

In another aspect, the present invention also includes a consumable pod. The consumable pod is formed to contain a consumable item therein and has a capping surface with both a pod inlet and a pod outlet formed therethrough.

In another aspect, the capping surface of the consumable pod includes a cap recess that is formed to receive and accommodate a heating plate.

In yet another aspect, the pod inlet and the pod outlet are formed such that when the consumable pod is positioned within the head, the pod inlet and pod outlet align with the top inlet and top outlet, respectively.

In another aspect, a tear-off lid is affixed with the consumable pod to conceal the capping surface and consumable item therein.

In yet another aspect, the consumable item is shisha.

Finally, as can be appreciated by one in the art, the present invention also comprises a method for forming and using the invention described herein.

BRIEF DESCRIPTION OF THE DRAWINGS

The objects, features and advantages of the present invention will be apparent from the following detailed descriptions of the various aspects of the invention in conjunction with reference to the following drawings, where.

Figure 8A:
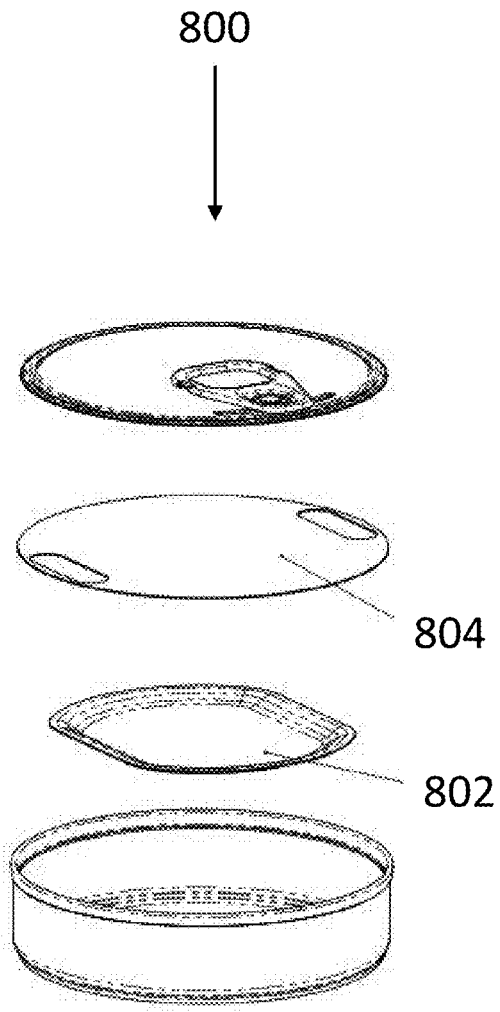
Figure 8B:
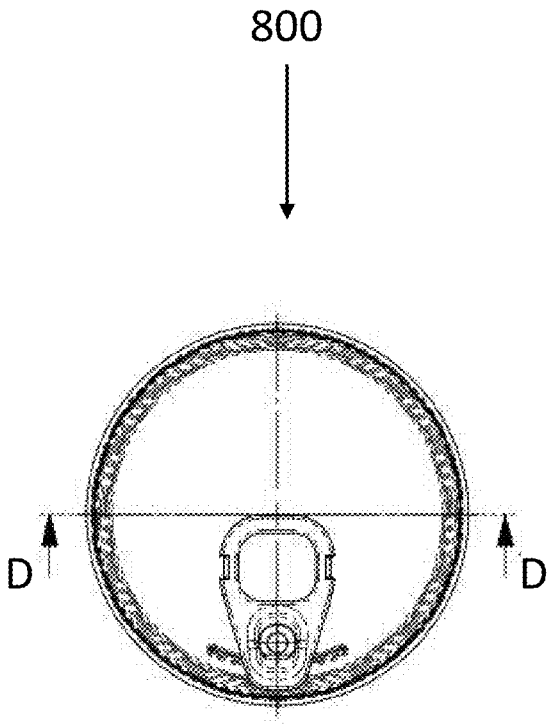
Figure 8C:
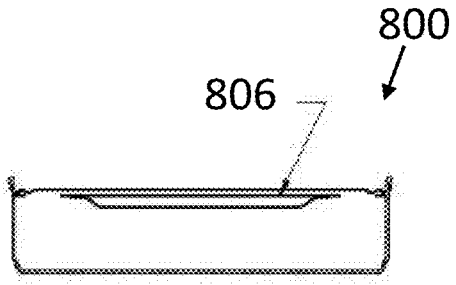
Figure 9A:
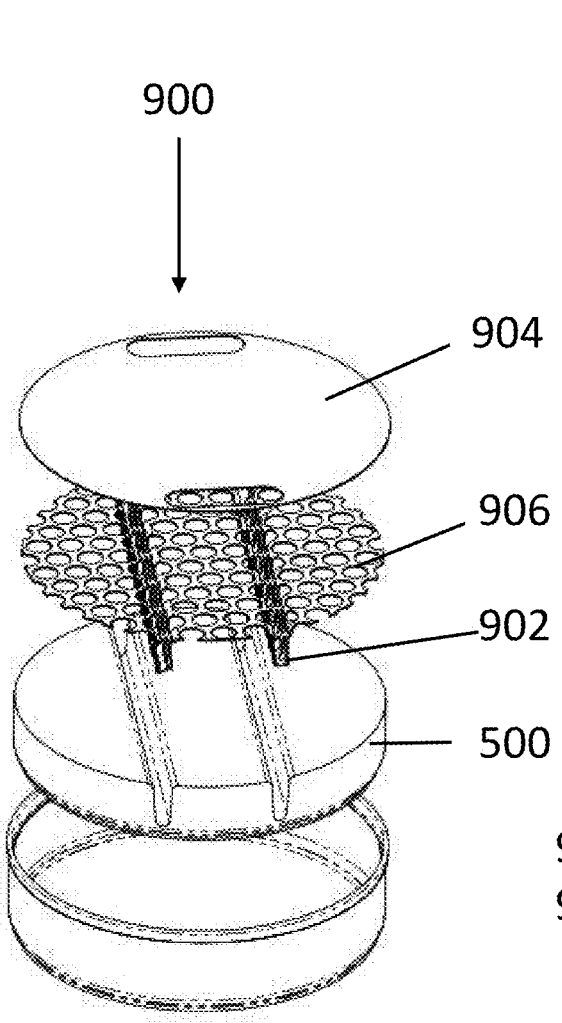
Figure 9B:
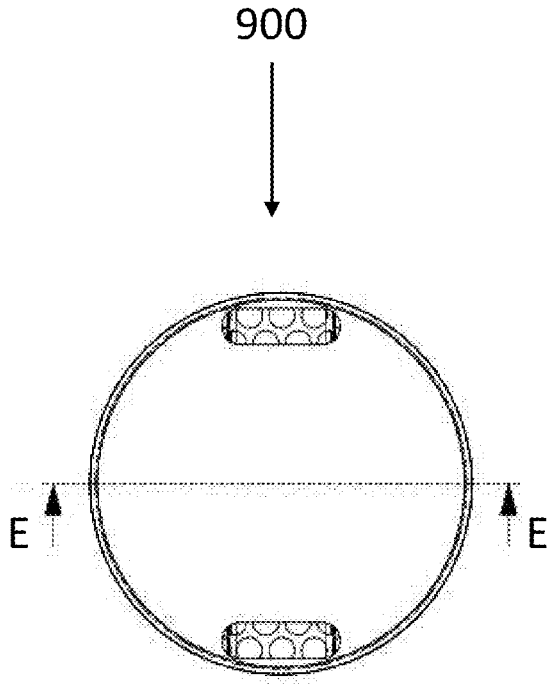
Figure 9C:
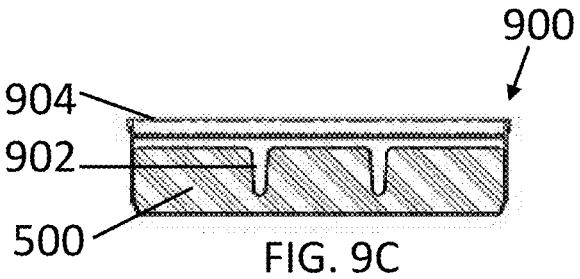
Figure 10A:
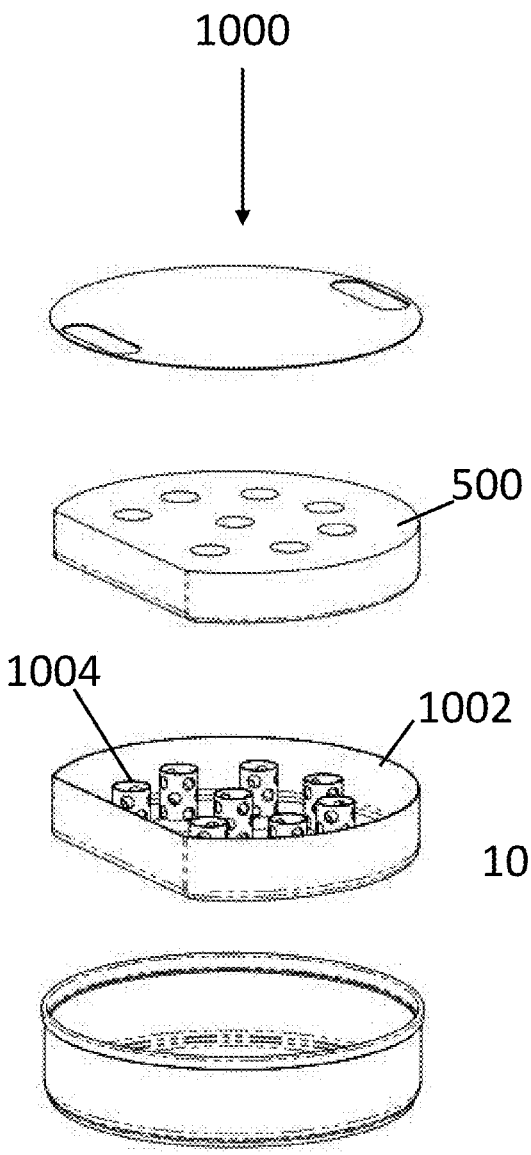
Figure 10B:
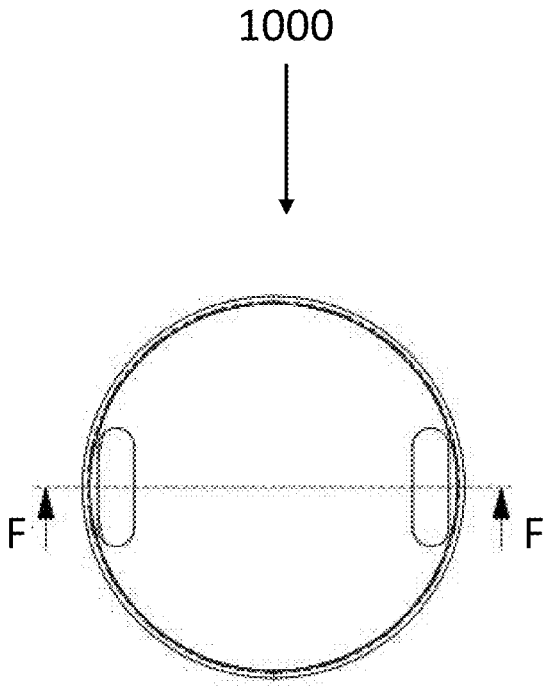
Figure 10C:
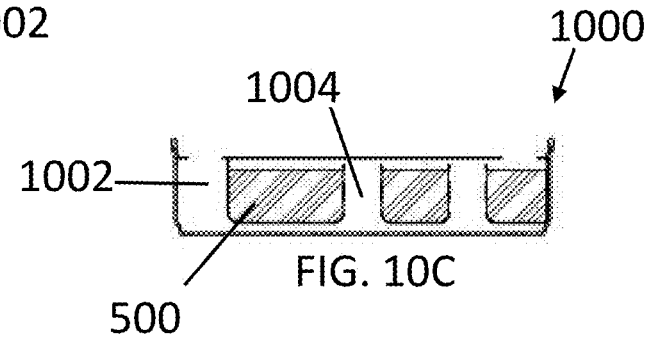

8A is an elevated, exploded-view illustration of a consumable pod according to various embodiments of the present invention;

FIG. 8B is a top-view illustration of the consumable pod as depicted in FIG. 8A;

FIG. 8C is a cross-sectional, side view illustration of the consumable pod, taken along line D-D of FIG. 8B;

9A is an elevated, exploded-view illustration of a consumable pod according to various embodiments of the present invention;

FIG. 9B is a top-view illustration of the consumable pod as depicted in FIG. 9A;

FIG. 9C is a cross-sectional, side view illustration of the consumable pod, taken along line E-E of FIG. 9B;

10A is an elevated, exploded-view illustration of a consumable pod according to various embodiments of the present invention;

FIG. 10B is a top-view illustration of the consumable pod as depicted in FIG. 10A; and FIG. 10C is a cross-sectional, side view illustration of the consumable pod, taken along line F-F of FIG. 10B.

DETAILED DESCRIPTION

The present invention relates to a hookah device and, more particularly, to various hookah components individually and, collectively as forming a complete hookah device that is designed to smoke a variety of items. It should be noted that although the term "combustible" is used herein, the invention is not intended to be limited thereto as it can also be used to heat any item in which it may be desirable to generate a vapor, smoke, or other inhalation product, non-limiting examples of which include liquids, oils, rosins, plant product such as tobacco, hashish or shisha, etc. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

(1) Description

The present invention is directed to a hookah device having various components that individually and collectively provide an improvement over traditional hookah devices through use of a consumable pod in conjunction with a strategically designed head. More specifically and as described in further detail below, the figures submitted herewith depict various hookah components as forming a complete hookah designed to smoke a variety items. The invention includes a complete hookah device and, in other aspects, is directed to specific components as described and illustrated that can be used with any hookah device, including any or all of the components (or any combination thereof) as illustrated in U.S. Provisional Application No. 62/815,167, filed on Mar. 7, 2019 and U.S. Provisional Application No. 62/929,273, filed Nov. 1, 2019, the entirety of which are incorporated herein by reference.

Figure 1:
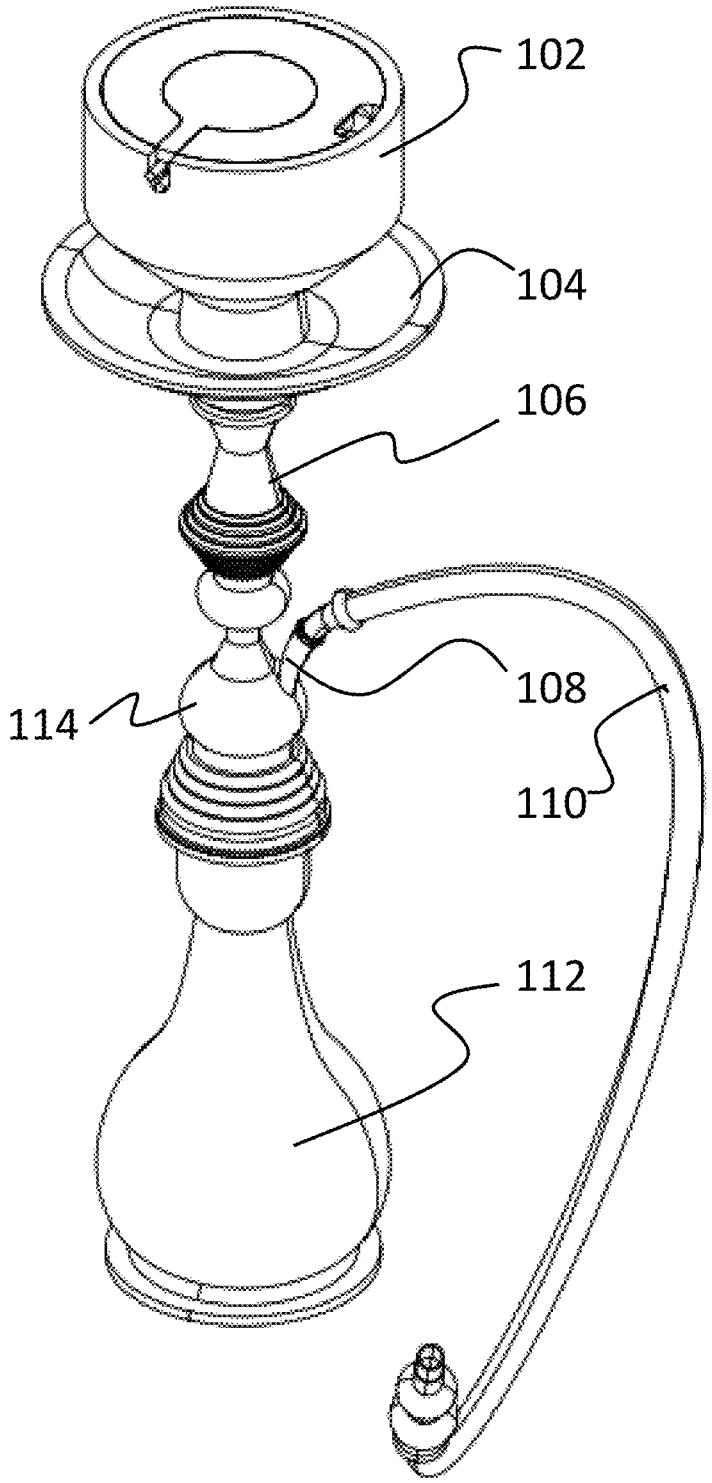
FIG. 1 is an elevated-view illustration of a hookah device according to various embodiments of the present invention.
Figure 2:
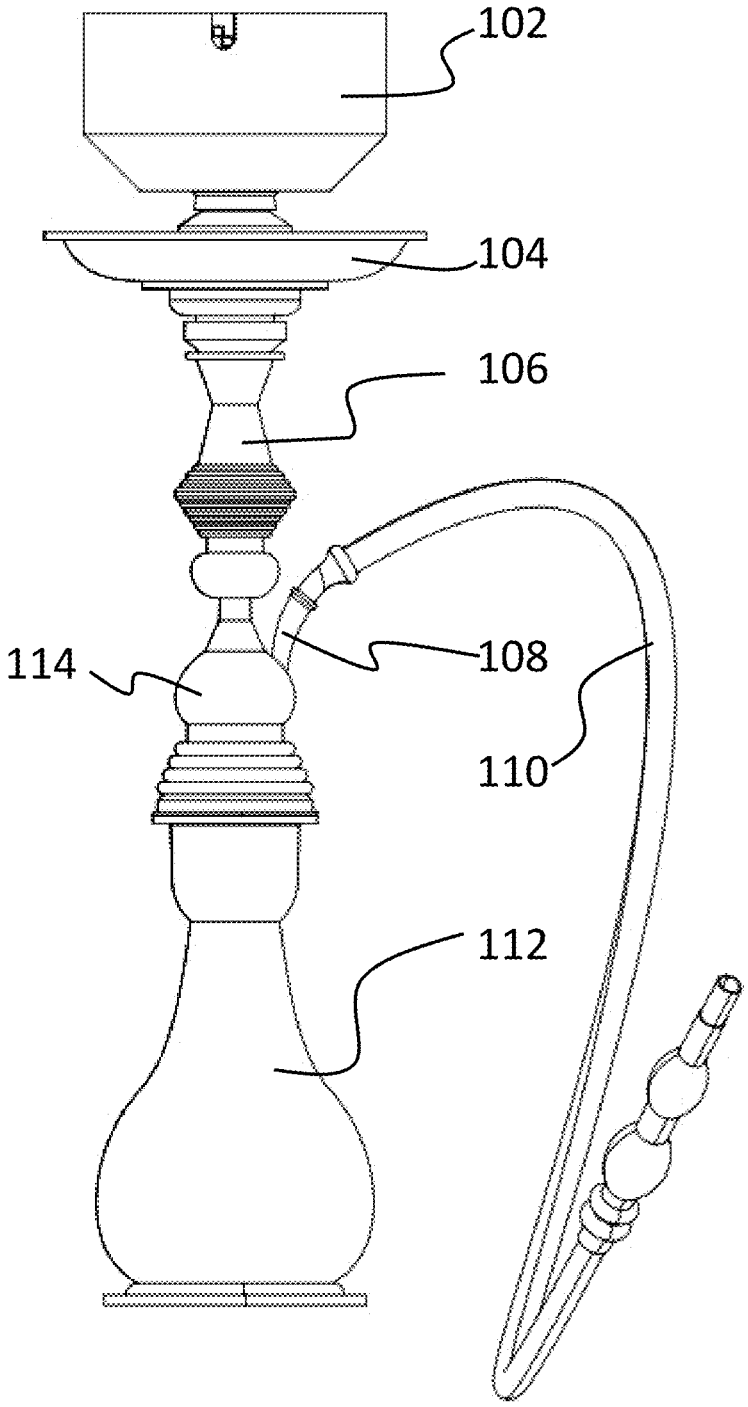
FIG. 2 is a side-view illustration of the hookah device according to various embodiments of the present invention.
Figure 3:
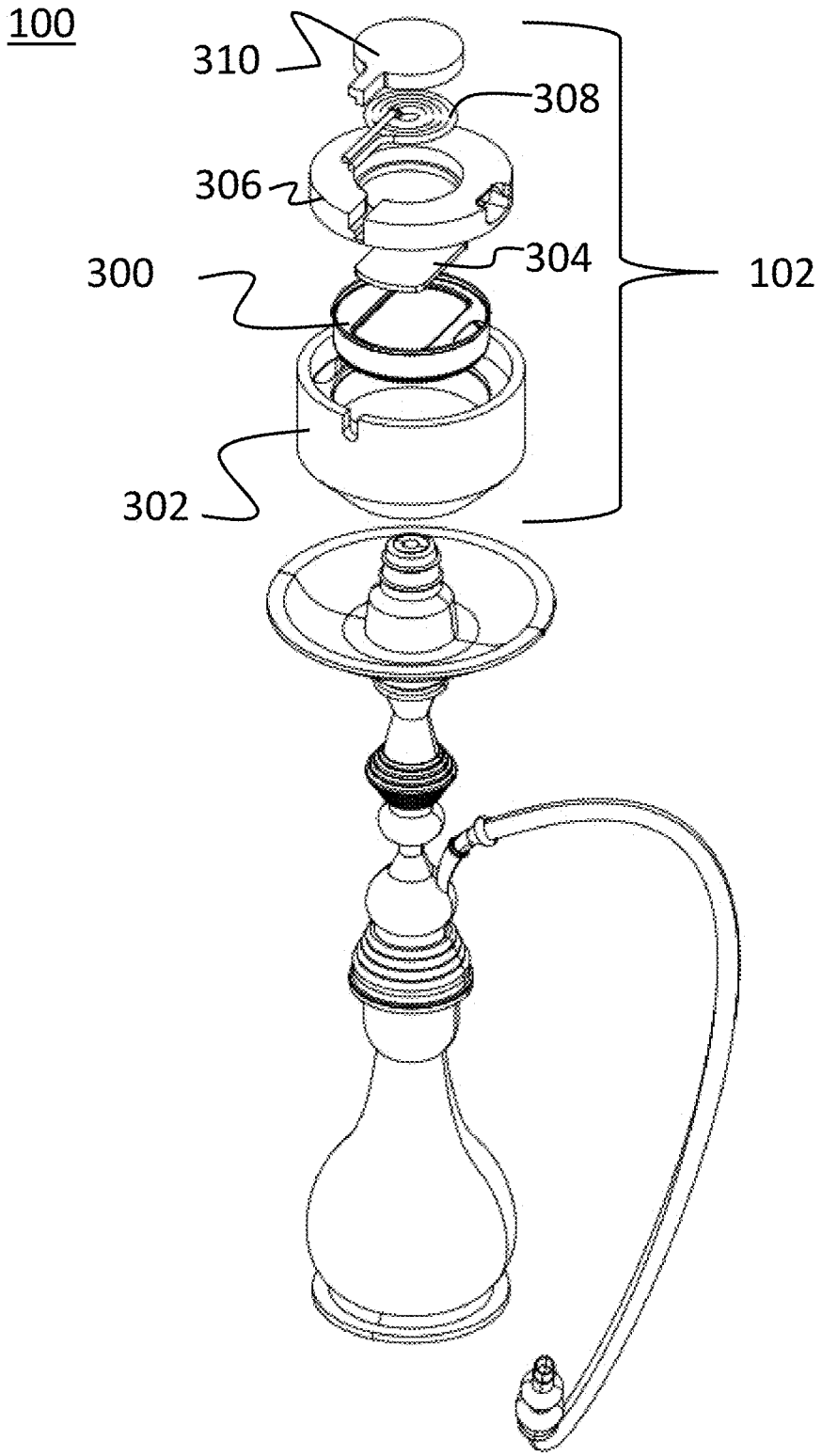
FIG. 3 is an elevated, exploded-view illustration of the hookah device according to various embodiments of the present invention.

As shown in FIGS. 1 and 2, the present disclosure is directed to a hookah device 100. The hookah device 100 is designed to appear like a traditional hookah (although it is not limited thereto) and includes any relevant component as may be needed to use the hookah device 100, including but not limited to a head 102, a tray 104 (optional), a stem or shank 106, and a hose port 108 projecting from a hookah body 114. A hose 110 is attached with the hose port 108, while a vase 112 rests below the hookah body 114. However and as shown in the exploded-view illustration of FIG. 3, the hookah device 100 provides a marked improvement over the prior art through a new and improved head 102 design.

The head 102 is designed to receive and heat a consumable pod 300 (and the components therein). The consumable pod 300 includes a combustible item or any other material that, when heated, generates smoke or vapor for inhalation. As a non-limiting example, the consumable pod 300 includes shisha, marijuana, herbal products, a liquid such as oil or rosin, etc.

The head 102 is formed in any suitable shape and includes any necessary components to heat the related consumable pod 300. As a non-limiting example, the head 102 includes a bowl portion 302 that includes a recess to receive the consumable pod 300. An electronic heating mechanism is included to heat the consumable pod 300 and its internal combustible or other items (e.g., shisha, liquid, etc.). For example, the heating mechanism includes a heating plate 304 (e.g., a ferrous plate or other thermally conductive material) that can be pressed against the consumable pod 300. A bowl top 306 is included to maintain the heating plate 304 pressed against the consumable pod 300 for sufficient heat transfer, while the heating plate 304 serves to distribute heat evenly across the consumable pod 300. Importantly, a heater 308 is included to heat the heating plate 304. The heater 308 is any suitable mechanism or device that operates to provide heat to the consumable pod 300, either directly or indirectly (e.g., through the heating plate 304). A non-limiting example of such a heater 308 includes an electric induction coil (as depicted). Finally and in various embodiments, a head cap 310 is included to securely affix the heater 308 in place and against the heating plate 304.

In a desired aspect, the head 102 is formed as a permanent component that is securely affixed with the hookah body 114 to form the hookah device 100. In another aspect, the head 102 can be formed to be sold separately and/or otherwise affixed on any conventional hookah body. As a non-limiting example and as shown in FIGS. 4B and 4C, a tapered interface 400 can be formed in the bottom of the head 102 to allow the head to securely engage with a correspondingly tapered portion 402 of a hookah body 114. Alternatively, in one non-limiting example, the hookah device will use a proprietary interface to selectively connect to the rest of the system (stem, water bowl and hose). For example, a rubber sleeve with a series of teethed ridges can be wrapped around the tip of the hookah body to allow tapered portion 402 to be securely press fit and affixed against the hookah body. Thus and as can be appreciated by those skilled in the art, there are a number of techniques by which the hookah head 102 can be affixed with the hookah body 104. As noted above, it should be understood that the components of the head 102 as described and illustrated can be implemented in either removable or permanently affixed (with the hookah body) versions. In other words and as referenced above, the head 102 can be permanently affixed with the hookah body 114. In such an embodiment, all the relevant components as described and illustrated are implemented into a permanently affixed head 102. Further details regarding the various components of the head 102 are provided below.

Figure 4A:
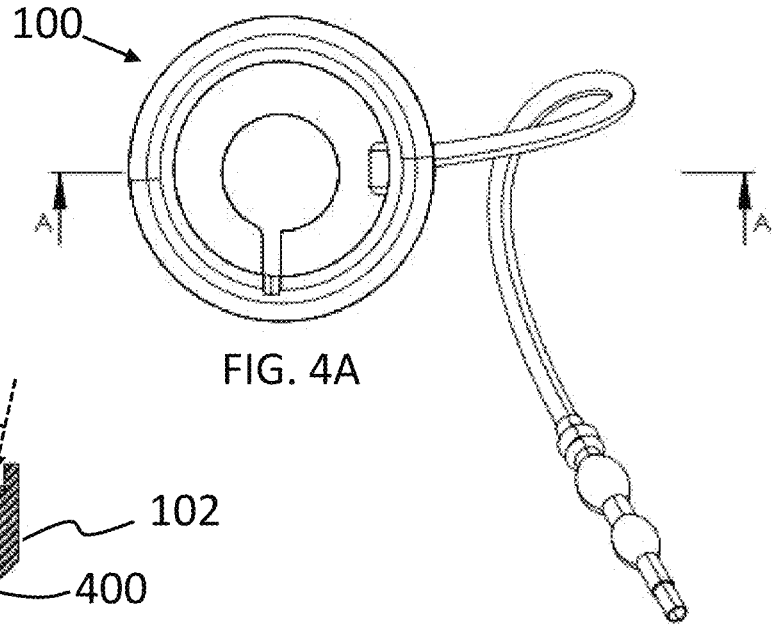
FIG. 4A is a top-view illustration of the hookah device according to various embodiments of the present invention.
Figure 4B:
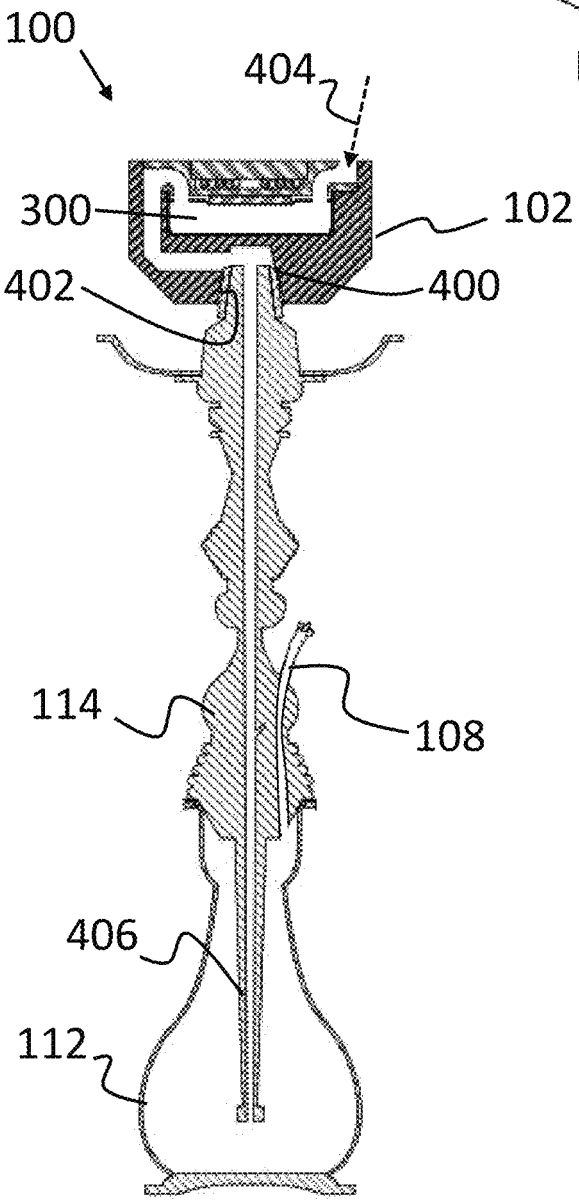
FIG. 4B is a cross-sectional, side-view illustration of the hookah device, taken along line A-A of FIG. 4A.
Figure 4C:
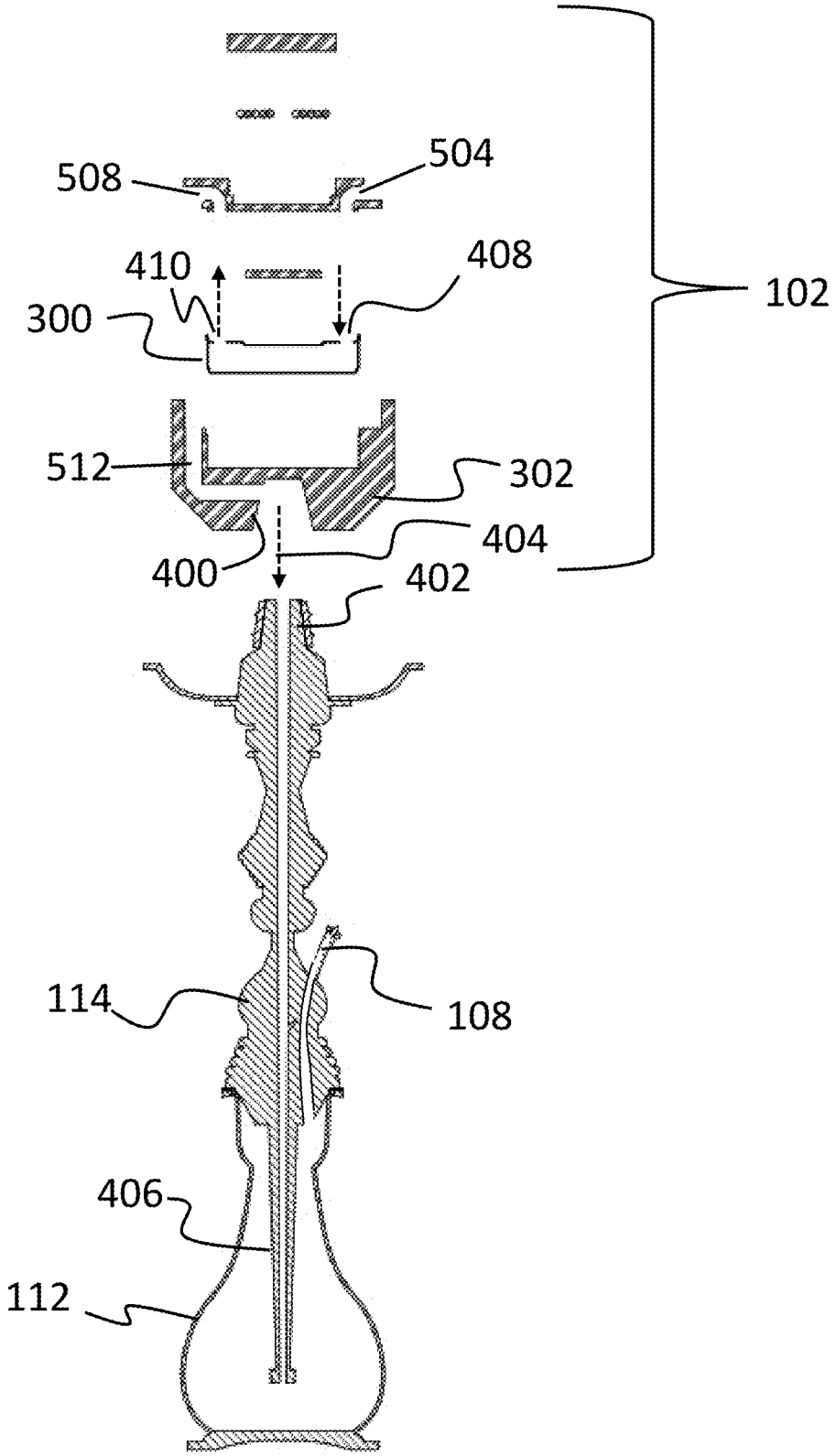
FIG. 4C is an exploded-view illustration of the hookah device as depicted in FIG. 4B.

FIGS. 4A and 4B depict a top-view and cross-sectional side view, respectively, of the hookah device 100. For further understanding, FIG. 4C provides an exploded-view of the head 102 as depicted in FIG. 4B. As shown in FIGS. 4B and 4C, an air pathway 404 passes through the head 102 (and its contained consumable pod 300), through the hookah body 114 and into a down stem 406, which introduces the gas product (i.e., smoke) into the vase 112. The smoke then leaves the vase 112 through the hose port 108 (and subsequent hose) for inhalation by the user. In some aspects, a valve can be included at any desired location within the air pathway or in the hose port 108 or hose.

As noted above, a unique aspect of the present invention is the inclusion of the head 102 and corresponding consumable pod 300. As described in further detail below, the consumable pod 300 can be designed in a variety of forms to address several issues as present in traditional hookah devices. By way of example, the consumable pod 300 was designed to address leaking issues that are typical of current electronic hookah solutions. Leaking is an issue because it can cause the entire stem to be tainted with the liquid, making it very difficult to clean and leaving residue from one session to the other, coloring the water, losing flavor. Further, instead of heating the liquid for consumption, leaking liquid is in essence the loss of liquid (i.e., the liquid is escaping), which results in a hookah session as not lasting as long as may be desired. The present invention addresses this issue by arranging both the pod inlet 408 (for ambient air) and pod outlet 410 (for smoke) in a top-facing, secondary capping surface of the consumable pod 300. These aspects are further illustrated in FIGS. 5A and 5B.

As noted above and as shown in FIGS. 4C, 5A and 5B, the head 102 is formed to receive the consumable pod 300. It should be understood that the head 102 is formed in any suitable manner or shape to receive and heat the consumable pod 300. In some aspects, the consumable pod 300 can be inserted through a side pod recess of the bowl portion 302. In other aspects, the consumable pod 300 is placed into a top pod recess. Thus, although a specific head 102 shape is illustrated and described below, it should be understood that the invention is not intended to be limited thereto. For example, in one aspect, a pod recess 518 is formed within the bowl portion 302 to receive and securely hold the consumable pod 300. Above and circumnavigating the pod recess 518 is a step 502 that is formed to receive the bowl top 306. Desirably, the consumable pod 300, bowl portion 302 and bowl top 306 are formed to allow air passage (via the air pathway) therethrough. For example, the bowl top 306 includes a top inlet 504 that aligns with the pod inlet 408 to introduce air 506 into the consumable pod 300. The bowl top 306 also includes a top outlet 508 that aligns with the pod outlet 410 to receive smoke 510 from the top of the consumable pod 300 and direct the smoke 510 back down into a smoke passageway 512 formed through the bowl portion 302. Thus, the bowl top 306 effectively seals the bowl portion 302, excepting the top inlet 504.

The bowl top 306 also includes a centrally formed heater recess 514 that is formed to securely hold the heater 308 while allowing the heater 308 to directly engage with the plate 304. For example, a hole 520 is formed through the bowl top 306 with a circumnavigating heater step formed around the hole 520 to receive and hold the heater 308. Also and as noted above, the consumable pod 300 includes a capping surface to conceal the consumable item 500 (e.g., shisha) therein. The capping surface includes both the pod inlet 408 and pod outlet 410. Desirably, the capping surface includes a cap recess 516 that is formed to receive and accommodate the heating plate 304. Thus, when the heater 308 is positioned within the heater recess 514, the plate 304 is held securely between the heater 308 and cap recess 516 to transfer heat through the top of the consumable pod 300 and burn the item 500 therein.

It should be understood that any suitable heating technique can be employed according to various embodiments of the present invention. In one aspect and as illustrated, the heat source (i.e., heater 308) is placed on top of the consumable pod 300, not below. While one can envision an embodiment in which the heater 308 is below the pod 300, the heater 308 is desirably on top of the pod 300 (as illustrated) to provide a smoking experience as close to a conventional experience, in terms of taste and volume of smoke, as possible. The conventional experience is largely provided through controlled and even heating of the pod 300 and consumable item or product therein. In this aspect, the device moves away from the more even baking to more of a gradient heating approach, with a system that is closer to an electric version of the coal that is conventionally used. It should be noted that a problem with traditional coal heated hookahs includes the hazard of lighting the coal, the inhalation of toxins emitted by burning coal, and a variety of safety concerns. Thus, the head 102 and pod 300 described herein address such issues through a controlled and even heating process. It should also be noted that this approach does not necessarily require an induction heat source, although such a heater 308 is desirably included. Further, it should be understood that the electronic heating mechanism includes any relevant components as may be necessary to cause the heater 308 to heat and operate as desired, non-limiting examples of which includes electrical cords, wires, outlet plugs, batteries, temperature control switches (if a temperature control is desired), etc. Thus, depending on the desired configuration, the electronic heating mechanism includes the relevant components to cause the heater 308 to receive the current or other characteristics as may be required to heat.

In one aspect, the heater 308 uses a multi-stranded copper (or other suitable metal or material) wire, arranged in a flat coil, to form an electromagnetic induction coil (typical of those found in induction stove tops). As noted above, the coil is set into the bowl top 306, and capped off with the head cap 310. The ends of the copper wire of the coil are connected to a driver circuit. The induction field that is created when the coil is powered by a high-frequency oscillating current (or other suitable driver) serves to heat up a ferrous plate 304 that forms the ultimate heat source, and is what replaces the coals used in a conventional hookah system. Although an induction coil is described above, it should be understood that the invention is not intended to be limited thereto as any electric heating type mechanism can be employed as the heater 308.

The ferrous plate 304 heats up enough to raise the temperature of the shisha (or other consumable item 500) that is in the consumable pod 300 to the point that is begins to smoke. When the user sucks on the hose, ambient air is drawn in through the top inlet 504 and is forced through the pod 300. As it is shown, the consumable pod 300 fills up all the way to the top of the pod 300, but in reality there could be an air gap between the top of the item 500 and the top surface of the pod 300, between the two openings 408 and 410. As the air is drawn through consumable pod 300 and out of the pod outlet 410 towards the stem, it brings with it the smoke 510 created from heating the consumable item 500.

In another aspect, the heater can provide for induction heating by utilizing electromagnetic induction to warm the bowl without touching it. For example, a metal coil can be imbedded into the hookah body and run a high frequency alternating current which creates an alternating electromagnetic field. Since the bowl in this aspect is made of a ferromagnetic material such as, but not limited to, stainless steel, the bowl heats up due to its magnetic hysteresis losses. In other words, the bowl's magnetic field cannot change as quickly as the electromagnetic field the coil is creating. This resistance of the changing magnetic field turns into heat very rapidly.

In yet another aspect and as shown in FIGS. 6A through 6D, the bowl top 306 can be formed such that the top inlet 504 provides for intake heating. In this aspect, the ambient air that is drawn into the consumable pod 300 is heated before it reaches the consumable pod 300 using an air heater 600. For example, the air heater 600 can be a heating element such as nichrome wire. In some aspect, the heating wire (i.e., air heater 600) can be configured to heat up when a draw of air is sensed using sensors or other suitable components to provide for such a function. A reason for this aspect would be to more closely replicate a conventional shisha bowl, where the air entering the bowl is heated by the coals that sit on top of the foil prior to contacting the shisha itself. Thus and as can be appreciated by those skilled in the art, there are a variety of techniques by which the consumable pod 300 can be heated in accordance with the present invention.

Figure 5A:
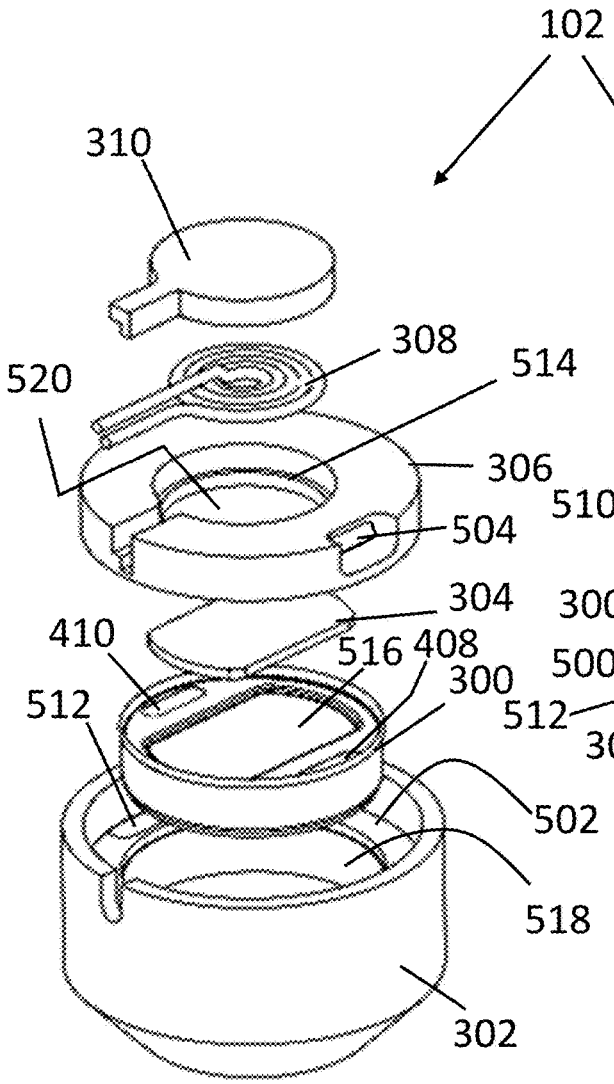
FIG. 5A is an elevated, exploded-view illustration of a head of the hookah device according to various embodiments of the present invention.
Figure 5B:
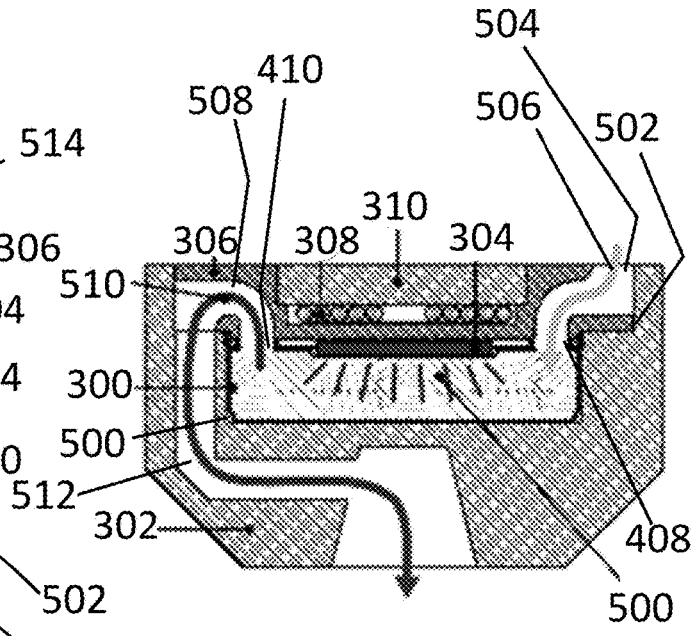
FIG. 5B is a cross-sectional, side view illustration of the head of the hookah device as depicted in FIG. 5A.
Figure 6A:
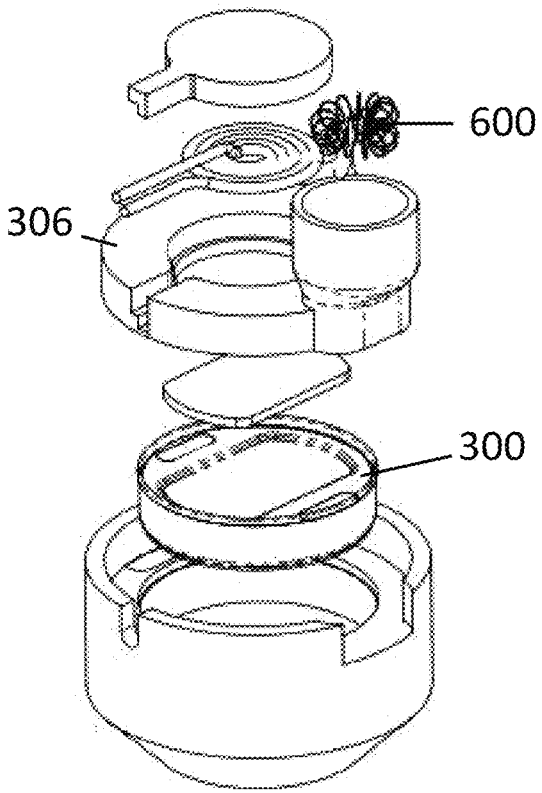
FIG. 6A is an elevated, exploded-view illustration of a head of the hookah device according to various embodiments of the present invention.
Figure 6B:
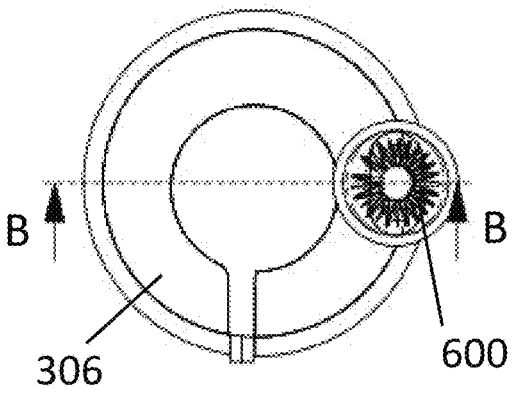
FIG. 6B is a top-view illustration of the head of the hookah device as depicted in FIG. 6A.
Figure 6C:
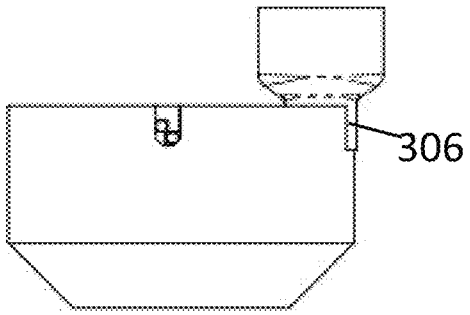
FIG. 6C is a side-view illustration of the head of the hookah device as depicted in FIG. 6A.
Figure 6D:
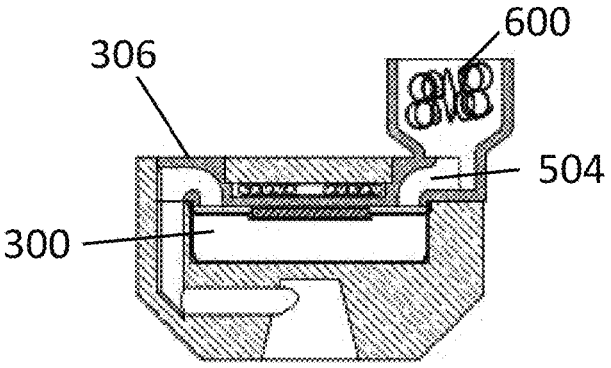
FIG. 6D is a cross-sectional, side view illustration of the head of the hookah device, taken along line B-B of FIG. 6B.
Figure 7A:
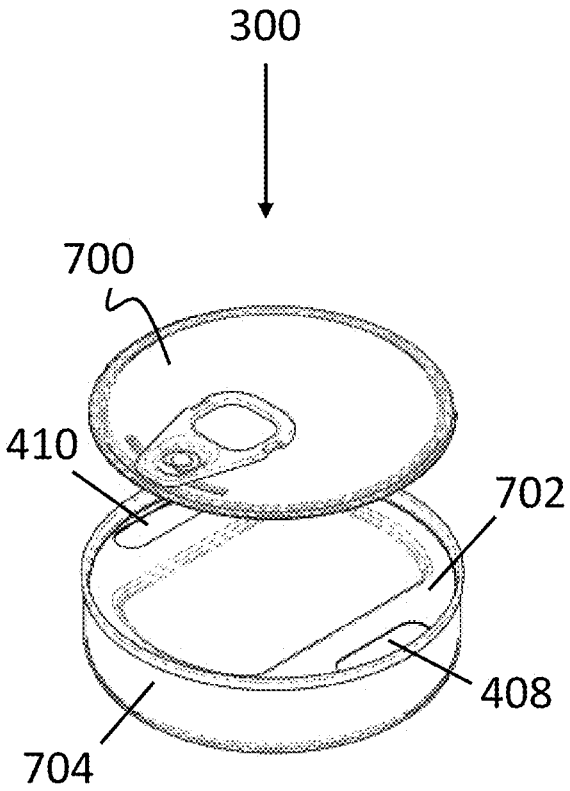
FIG. 7A is an elevated, exploded-view illustration of a consumable pod according to various embodiments of the present invention.
Figure 7B:
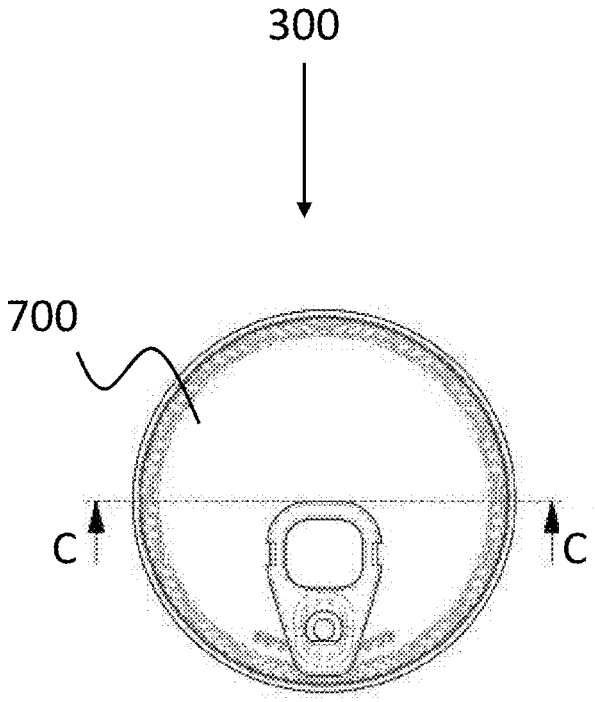
FIG. 7B is a top-view illustration of the consumable pod as depicted in FIG. 7A.
Figure 7C:
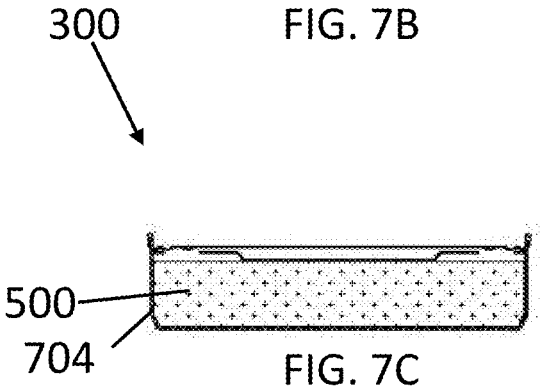
FIG. 7C is a cross-sectional, side view illustration of the consumable pod, taken along line C-C of FIG. 7B.

It should also be noted that the consumable pod 300 can be formed in any suitable shape or manner to operate with the hookah device of the present invention. For example, although the consumable pod 300 is illustrated as a circular can, it can also be in round form (or any other form), like a sardine can. Notably and as shown in FIGS. 7A through 7C, the consumable pod 300 includes several features that overcome deficits in the prior art. For example, the consumable pod 300 is self-contained such that after use, one need only throw the pod 300 away as opposed to trying to clean out a bowl. Further, the consumable pod 300, in some aspects, includes a lid 700. The lid 700 is any suitable lid that allows for sealing and easy removal. For example, the lid 700 can be a tear-off cap or membrane, similar to a metal or aluminum tear-off lid as commonly used in a variety of packaging. Underneath the removable lid 700 is the capping surface 702 of the consumable pod 300 that contains the pod inlet 408 and pod outlet 410. Also depicted is the shell 704 which serves as the housing to hold the consumable item 500. Thus, the consumable pod 300 is unique in as much as it contains a fixed capping surface 702 that remains in place after the removal of the lid 700. As noted above, this capping surface 702 provides the two openings 408 and 410 that form a seal with the two air channel ports (i.e., the top inlet 504 and top outlet 508 as depicted in FIGS. 4C, 5A and 5B) when the consumable pod 300 is placed in the head for use.

Also as noted above, the capping surface 702 of the consumable pod 300 is shown with a cap recess 516 for the heating plate (although desirable to securely affix the plate, such a feature is not critical to the heat transfer function). In a desired aspect, a gasket material can be included, which would be stuck to the underside of the tear-off lid 700 to seal off the top of the openings 408 and 410, to prevent the egression of glycerin and flavorings from leaking between the tear-off lid 700 and secondary capping surface 702 during transit.

Another example of a consumable pod is depicted in FIGS. 8A through 8C. The consumable pod 800 in this example includes an insulating layer 802 (e.g., metal layer) affixed or otherwise positioned below the capping surface 804. In this aspect, the insulating layer 802 provides for even heating of the shisha (and reduced burning) by creating an air void 806 to prevent direct contact between the very hot capping surface 804 and the shisha within the consumable pod 800.

Yet another example of a consumable pod is depicted in FIGS. 9A through 9C. The consumable pod 900 in this example includes one or more heater channels 902 that can be positioned within the item 500 and below the capping surface 904. The heater channels 902 are metal or otherwise thermally conductive channels that can be pressed into eh shisha. A mesh material 906 may optionally be included to help transfer the temperature to the heater channels 902. Here, the aim is to create a larger surface area of item 500 that may be more directly heated, and allow additional airflow through the item 500 for a greater volume of smoke. The mesh material 906 may be included to heat up to augment the radiant heat from the top of the pod 900 with some more direct heating, through contact with the item 500 itself.

Another example of a consumable pod is depicted in FIGS. 10A through 10C. The consumable pod 1000 in this example includes an inner shell 1002 with one or more air canisters 1004. The inner shell 1002 is positioned within the consumable pod 1000 and holds the item 500. The purpose of the inner shell 1002 in this example is to more closely replicate a conventional shisha bowl, by having air holes through the item 500 mass so as to increase the smoke output potential of the pod 1000. Desirably, with all pod concepts, the pod inlet and outlet apertures remain on the top surface, to minimize the spread of heated up nicotine- and glycerin-based liquid that create a significant cleaning burden.

It should be noted that the present disclosure is directed to not only a comprehensive hookah device as described and illustrated, but also to the individual components, or any combination thereof. Thus, the present invention is directed to each of the innovative aspects as described and illustrated in in the figures, both individually, collectively, or any combination thereof. Further, in another aspect, it should be noted that components can be incorporated into a traditional hookah to swap out the appropriate component individually, as multiple components, or any combination thereof. For example, the head as described can be used with a traditional hookah device to replace the heating chamber of such a traditional hookah.

It should also be noted that while the description and figures may reference particular shapes and materials, the invention is not intended to be limited thereto as the shapes and materials can be modified as needed or desired to provide a similar function. Finally, while this invention has been described in terms of several embodiments, one of ordinary skill in the art will readily recognize that the invention may have other applications in other environments. It should be noted that many embodiments and implementations are possible. Further, the following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means". Further, while particular method steps have been recited in a particular order, the method steps may occur in any desired order and fall within the scope of the present invention.

What is claimed is:

1. A consumable pod for use with a hookah device, comprising:

a shell having a consumable item therein, the shell having an impermeable bottom surface and impermeable side walls;

a top capping surface fixed to and positioned over the shell, the top capping surface having both a downward facing pod inlet and a upward facing pod outlet formed therethrough, the shell and caping surface defining a cavity therebetween in which the consumable item resides;

wherein the upward facing pod inlet and the downward facing pod outlet are formed as air pathway apertures into and out of the cavity to pass air into and out of the consumable pod;

wherein the capping surface of the consumable pod includes a cap recess that is formed to receive and accommodate a heating plate; and wherein the cap recess is formed between the downward facing pod inlet and upward facing pod outlet.

2. A consumable pod for use with a hookah device, comprising:

a shell having a consumable item therein, the shell having an impermeable bottom surface and impermeable side walls;

a top capping surface fixed to and positioned over the shell, the top capping surface having both a downward facing pod inlet and a upward facing pod outlet formed therethrough, the shell and caping surface defining a cavity therebetween in which the consumable item resides;

wherein the upward facing pod inlet and the downward facing pod outlet are formed as air pathway apertures into and out of the cavity to pass air into and out of the consumable pod; and further comprising one or more heater channels projecting below the capping surface and into the cavity.

3. A consumable pod for use with a hookah device, comprising:

a shell having a consumable item therein, the shell having an impermeable bottom surface and impermeable side walls;

a top capping surface fixed to and positioned over the shell, the top capping surface having both a downward facing pod inlet and a upward facing pod outlet formed therethrough, the shell and caping surface defining a cavity therebetween in which the consumable item resides;

wherein the upward facing pod inlet and the downward facing pod outlet are formed as air pathway apertures into and out of the cavity to pass air into and out of the consumable pod; and wherein the top capping surface has two opposing ends, such that each of the upward facing pod inlet and the downward facing pod outlet are formed opposite one another and adjacent to one of the two opposing ends.

* * * * *